US008110087B2

(12) United States Patent
Linde et al.

(10) Patent No.: US 8,110,087 B2
(45) Date of Patent: Feb. 7, 2012

(54) PRODUCTION OF A STRUCTURED HARD CHROMIUM LAYER AND PRODUCTION OF A COATING

(75) Inventors: Rudolf Linde, Wermelskirchen (DE); Stefan Dürdoth, Burscheid (DE); Wolfgang Stuckert, Wermelskirchen (DE)

(73) Assignee: Federal-Mogul Burscheid GmbH, Burscheid (DE)

( * ) Notice: Subject to any disclaimer, the term of this patent is extended or adjusted under 35 U.S.C. 154(b) by 1069 days.

(21) Appl. No.: 11/587,117

(22) PCT Filed: Jan. 5, 2005

(86) PCT No.: PCT/EP2005/000037

§ 371 (c)(1), (2), (4) Date: Oct. 20, 2006

(87) PCT Pub. No.: WO2005/108648

PCT Pub. Date: Nov. 17, 2005

(65) Prior Publication Data

US 2008/0060945 A1 Mar. 13, 2008

(30) Foreign Application Priority Data

Apr. 21, 2004 (DE) ..... 10 2004 019 370

(51) Int. Cl.

| | |
|---|---|
| ***C25D 3/10*** | (2006.01) |
| ***C25D 3/04*** | (2006.01) |
| ***C25D 5/12*** | (2006.01) |
| ***C25D 5/14*** | (2006.01) |

(52) U.S. Cl. ..... 205/290; 205/178; 205/179; 205/283

(58) Field of Classification Search ..... 205/283, 205/290, 178, 179

See application file for complete search history.

(56) References Cited

U.S. PATENT DOCUMENTS

| | | | | |
|---|---|---|---|---|
| 3,090,733 | A * | 5/1963 | Brown | 428/639 |
| 3,139,393 | A * | 6/1964 | Passal et al. | 205/280 |
| 3,901,659 | A | 8/1975 | Jokik et al. | |

(Continued)

FOREIGN PATENT DOCUMENTS

| | | |
|---|---|---|
| CA | 2 172 613 C | 4/1995 |

(Continued)

OTHER PUBLICATIONS

Gardam, "The Production of Machinable Cr Deposits", *J. of the Electro-depositors' Technical Soc.* (no month, 1945), vol. 20, pp. 69-74.

(Continued)

*Primary Examiner* — Edna Wong

(74) *Attorney, Agent, or Firm* — Patterson Thuente Christensen Pedersen, P.A.

(57) ABSTRACT

A method for producing a structured hard chromium layer, during which chromium from an electrolyte is deposited onto a workpiece, which contains: a) a Cr(VI) compound in a quantity corresponding to between 50 and 300 g/l of chromic anhydride; b) 0.5 g/l to 10 g/l sulfuric acid, and; c) 5 g/l to 15 g/l aliphatic sulfonic acid having 1 to 6 carbon atoms. The electrolyte comprises substantially no compounds from the group consisting of ammonium molybdate, alkaline molybdate, alkaline earth molybdate, ammonium vanadate, alkaline vanadate and alkaline earth vanadate, ammonium zirconate, alkaline zirconate and alkaline earth zirconate, and is processed with a cathodic efficiency of 12% or less. A method for producing a coating, to a structured hard chromium layer, a coating and an electrolyte.

20 Claims, 10 Drawing Sheets

U.S. PATENT DOCUMENTS

| | | | | | |
|---|---|---|---|---|---|
| 3,920,527 | A | * | 11/1975 | Dettke et al. | 205/113 |
| 3,951,759 | A | | 4/1976 | Studer | |
| 4,468,293 | A | | 8/1984 | Polan et al. | |
| 4,588,481 | A | | 5/1986 | Chessin et al. | |
| 4,590,239 | A | * | 5/1986 | Sugio et al. | 525/92 D |
| 4,846,940 | A | | 7/1989 | Neuhauser et al. | |
| 5,196,108 | A | * | 3/1993 | Wilmeth et al. | 205/243 |
| 5,325,732 | A | * | 7/1994 | Vogel | 74/89.44 |
| 5,415,761 | A | | 5/1995 | Müll | |
| 5,415,763 | A | | 5/1995 | Johnson et al. | |
| 6,319,385 | B1 | | 11/2001 | Müll | |
| 6,329,071 | B1 | | 12/2001 | Kobayashi et al. | |
| 6,355,366 | B1 | | 3/2002 | Santini | |
| 6,447,666 | B1 | | 9/2002 | Szameitat | |
| 6,478,943 | B1 | | 11/2002 | Lasia et al. | |
| 6,503,642 | B1 | | 1/2003 | Linde | |
| 6,562,216 | B2 | | 5/2003 | Schkenkert et al. | |
| 6,837,981 | B2 | | 1/2005 | Horsthemke | |
| 7,699,970 | B2 | | 4/2010 | Linde et al. | |
| 2003/0121794 | A1 | | 7/2003 | Horsthemke | |
| 2003/0134141 | A1 | * | 7/2003 | Okado et al. | 428/626 |
| 2006/0054509 | A1 | | 3/2006 | Linde | |
| 2007/0131558 | A1 | | 6/2007 | Horsthemke et al. | |
| 2010/0112376 | A1 | | 5/2010 | Linde et al. | |

FOREIGN PATENT DOCUMENTS

| | | | | |
|---|---|---|---|---|
| CS | 214 553 | | | 2/1984 |
| DE | 33 07 748 | A1 | | 9/1983 |
| DE | 35 31 410 | | | 3/1987 |
| DE | 42 11 881 | A1 | | 10/1993 |
| DE | 43 34 122 | A1 | | 4/1995 |
| DE | 44 32 512 | C2 | | 3/1996 |
| DE | 198 28 545 | C1 | | 8/1999 |
| DE | 102 55 853 | | | 6/2004 |
| DE | 10 2004 019 370 | | | 9/2005 |
| EP | 0 196 053 | A2 | | 10/1986 |
| EP | 0 217 126 | | | 4/1987 |
| EP | 0 668 375 | | | 8/1995 |
| EP | 0 841 413 | | | 5/1998 |
| EP | 1 114 209 | | | 7/2001 |
| EP | 1 205 582 | A1 | | 5/2002 |
| EP | 1 719 827 | | | 11/2006 |
| EP | 1 798 313 | | | 6/2007 |
| FR | 2 558 852 | | | 8/1985 |
| GB | 2 153 387 | | | 8/1985 |
| GB | 2 153 387 | A | | 8/1985 |
| GB | 2153387 | A | * | 8/1985 |
| WO | WO 01/04386 | | | 1/2001 |
| WO | WO 02/38835 | A1 | | 5/2002 |
| WO | WO 2004/050960 | | | 6/2004 |
| WO | WO 2004/050960 | A1 | | 6/2004 |
| WO | WO 2005/108648 | | | 11/2005 |

OTHER PUBLICATIONS

English Machine Translation of DE 44 32 512, printed from EPO website on Feb. 15, 2009; pp. 1-2.

Application and File History for U.S. Appl. No. 10/536,665, filed May 27, 2005, inventors Linde et al.

Application and File History for U.S. Appl. No. 12/683,890, filed Jan. 7, 2010, inventors Linde et al.

Application and File History for U.S. Appl. No. 12/936,158 filed Dec. 21, 2010, inventor Linde et al.

* cited by examiner

200 : 1

500 : 1

PRODUCTION OF A STRUCTURED HARD CHROMIUM LAYER AND PRODUCTION OF A COATING

FIELD OF THE INVENTION

The invention relates to a method of producing a structured hard chromium layer on a workpiece, to a method of producing a coating comprising a structured hard chromium layer, to structured hard chromium layers and coatings obtainable thereby and to an electrolyte for carrying out said methods.

BACKGROUND OF THE INVENTION

Electrochemically produced hard chromium layers serve not only the purpose of providing a decorative surface finishing. Rather, hard chromium layers are also applied as functional coatings on conducting and non-conducting workpieces, for example in order to exert a protecting function or to favorably influence the surface properties. Therefore, typical applications are protective hard chromium coatings for reduction of corrosion, wear or friction, as well as structured hard chromium layers on printing rollers facilitating wetting with printing inks, or on punching, embossing and deep-drawing tools so as to optimize manufacturing processes in industry.

EP 0 196 053 A2 and DE 34 02 554 A1 describe methods for electroplating of hard chromium on metallic surfaces from an aqueous electrolyte containing chromic acid, sulfuric acid or sulfate and a sulfonic acid, working with cathodic current yields ≧20%. The composition of the electrolyte is intended to eliminate the risk of detrimental etching of the surface to be coated. However, no structures are generated in the hard chromium layer.

A further electrochemical method for depositing hard chromium layers on workpieces is known from U.S. Pat. No. 5,196,108. The electrolyte used therein contains a molybdenum anion, making it possible to employ a high cathodic current yield. This method does not serve to structure a hard chromium layer.

An electrochemical method of generating structured hard chromium layers is known, for example, from DE 44 32 512 A1. It enables structuring of the hard chromium layer by adding salts, such as salts of the elements selenium or tellurium, to the electrolyte. However, the layers thus generated have a spherical structure, in fact, with spherical shapes having sizes between less than 1 μm and up to several μm. This results in an often non-uniform spherical structure of the hard chromium layer, which structure is not suitable for all applications.

SUMMARY OF THE INVENTION

The methods of producing a structured hard chromium layer according to the various embodiments of the present invention overcome the disadvantages of the prior art by providing a method of producing structured hard chromium layers having a uniform structure and effecting improvements with respect to the tribological properties of the workpiece, such as, for example, reduced wear and, in the case of insufficient lubrication, favorable emergency running properties.

A feature and advantage of an embodiment of the present invention is a method of producing a structured hard chromium layer, wherein chromium is deposited from an electrolyte on a workpiece, said electrolyte containing:

(a) a Cr(VI) compound in an amount corresponding to 50 g/l to 300 g/l of chromic acid anhydride;

(b) 0.5 g/l to 10 g/l of sulfuric acid;

(c) 5 g/l to 15 g/l aliphatic sulfonic acid comprising 1 to 6 carbon atoms;

wherein the electrolyte contains substantially none of the compounds selected from ammonium molybdate, alkali molybdate, alkaline earth molybdate, ammonium vanadate, alkali vanadate, alkaline earth vanadate, ammonium zirconate, alkali zirconate and alkaline earth zirconate, and wherein a cathodic current yield of 12% or less is employed.

Using the method, structured hard chromium layers are produced, which are cup-shaped and/or labyrinth-shaped and/or column-shaped. This is achieved by selectively influencing the cathode film which forms during electroplating, as will be explained below.

BRIEF DESCRIPTION OF THE DRAWINGS

Various embodiments of the invention will be explained in more detail in the following Examples, with reference to the Figures, but without limiting the invention thereto.

DETAILED DESCRIPTION OF THE INVENTION

Figure 1:
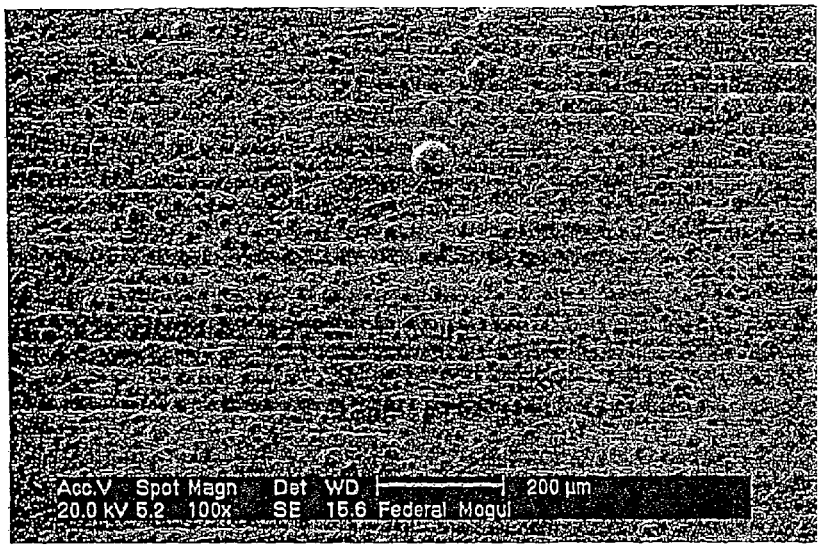
FIG. 1 is a photograph of a chromium layer of Example 1.

The electrolytes used in galvanic methods contain salts which dissociate into anions and cations in an aqueous medium. A hydrate shell forms around the dissociated ions. During the electrochemical deposition, hydrated metal ions of the electrolyte migrate to the workpiece to be coated, which is provided as the cathode. In the border region between the electrolyte and the cathode, the so-called cathode film is located directly on the surface of the cathode. If a hydrated metal ion reaches this phase boundary, said ion takes up electrons from the cathode and is thereby oriented in the diffusion zone.

Below this diffusion zone and directly on the cathode surface, an electrochemical bilayer, the "Helmholtz bilayer", is formed. This layer consists of an electrically charged zone at the interface between the electrolyte and the cathode and is approximately a few atom layers or molecule layers thick. Its formation involves ions, electrons or directed dipolar molecules. Since the "Helmholtz bilayer" is positively charged on one side and negatively charged on the other side, it behaves on the cathode like a plate capacitor with a very small plate spacing.

In order to enable the metal ion to reach the workpiece surface and to be incorporated in a growth position on the surface of the workpiece, the ion has to overcome the cathode film. This operation can be influenced by suitably selecting the deposition conditions, such as the chemical composition of the electrolyte, temperature, hydrodynamics and the electric current level. In order to form metal layers of uniform thickness on the workpiece, the deposition conditions for the electrolyte are selected such that the permeability of the cathode film to the metal ion is as uniform as possible.

If the element chromium is to be deposited from an aqueous electrolyte on a workpiece, the chromium is present in a strongly acidic solution as a negatively charged hydrogen dichromate complex. Therein, the chromium is at oxidation state 6 and may also contain small amounts of chromium (III) compounds.

However, if such a solution is electrolyzed, a solid film is formed on the cathode, preventing the chromium deposition. Only hydrogen forms which, due to its small radius, can permeate through the solid cathode film, in contrast to the large hydrogen dichromate ions. Only the addition of further ions, such as e.g. sulfate and chloride, makes the cathode film permeable to the chromium ions, and deposition of the chromium occurs via different oxidation states (see "Chemie für die Galvanotechnik" Leutze Verlag, 2nd ed., 1993).

The use of an electrolyte with a chromium (VI) compound in an amount corresponding to 50 to 300 g/l, preferably 50 to 150 g/l, of chromic acid anhydride, 0.5 to 10 g/l of sulfuric acid and 5 g/l to 15 g/l of aliphatic sulfonic acid comprising 1 to 6 carbon atoms causes the formation of a cathode film with a very tight barrier layer. If a suitably high coating current density is applied, the barrier layer strikes through, causing the formation of a chromium layer with non-uniform layer thickness on the workpiece, wherein a cathodic current yield of 12% or less is employed.

Thus, without the use of additives which favor forming the barrier layer of the cathode film, structured hard chromium layers having cup-shaped and/or labyrinth-like and/or column-shaped structures are formed. Therefore, compounds can be dispensed which promote the formation of a tight cathode film, such as e.g. ammonium molybdate, alkali molybdate, alkaline earth molybdate, ammonium vanadate, alkali vanadate, earth alkali vanadate, ammonium zirconate, alkali zirconate and alkaline earth zirconate.

The cathodic current yield of 12% or less ensures that in the method the structured hard chromium layer is formed, because structuring of the hard chromium layer is not obtained by a higher current yield.

Due to the cup-shaped and/or labyrinth-like and/or column-shaped structure, the structured hard chromium layers formed by the method according to the invention are formed more uniformly than the structured hard chromium layers of the prior art. Structured hard chromium layers obtainable by the method according to the invention are optimally suited for coating of piston rings, in particular those of combustion engines. In addition to high corrosion resistance, layers produced also have excellent tribological properties, such as good lubrication properties and resistance to wear and seizure, in particular in the case of insufficient lubrication. Further, the hard chromium layers obtained can be employed for many decorative and functional applications. The surface topography of the hard chromium layers produced according to the invention enables, for example, a high absorption for light and heat radiation in the use of solar panels. Further, the special structure of the hard chromium layers enables improved takeup of liquids. Also, gas cushions are easy to build up on the structured surface.

The above-indicated amounts of components (a) to (c) relate to the electrolyte. An electrolyte is understood herein to be aqueous solutions which are electrically conductive due to dissociated ions.

As component (a), i.e. the Cr(VI) compound, $CrO_3$ is preferably used because it is particularly suitable for electrolytic deposition.

As component (c), i.e. as the aliphatic sulfonic acid, methane sulfonic acid, ethane sulfonic acid, methane disulfonic acid or ethanedisulfonic acid are preferably used, which has turned out to be favorable for providing the advantageous decorative and functional properties of the generated hard chromium layer.

In one embodiment, the electrolyte may be essentially free from fluorides. This is because the latter often makes it difficult to form the structured hard chromium layer. Therefore, fluorides are tolerable in the electrolyte only in such amounts which do not affect the deposition of the structured hard chromium layer. It has proven favorable if no more than 0.1 g/l of fluorides are present in the electrolyte.

Moreover, conventional catalysts for chromium deposition, such as $SO_4^{2-}$ and/or $Cl^-$ can be contained in the electrolyte in usual amounts.

Structured hard chromium layers are deposited on workpieces by the above-described method. In this connection, the term "workpiece" refers to metallic or non-metallic objects which are to be provided with a structured hard chromium layer. In the case of a non-metallic object, such object is coated with a thin metal film in order to make the object electrially conductive, prior to depositing the structured hard chromium layer thereon.

In order to deposit the structured hard chromium layer on the workpiece, the latter is provided as the cathode and is immersed in the electrolyte. Then, a direct current, such as a pulsed direct current having a frequency of up to 1,000 Hz, is applied to the workpiece. During deposition of the chromium, the temperature is maintained at 45° C. to 95° C., preferably 55° C. The longer the deposition is carried out, the greater is the layer thickness of the hard chromium layer.

In the method, a current density of from 20 $A/dm^2$ to 200 $A/dm^2$ can be employed. This current density range leads to deposition of hard chromium layers having a particularly favorable structure. The higher a current density is selected here, the more dense will be the protruding regions of the surface of the hard chromium layer.

In a preferred embodiment of the method, a second layer is deposited before and/or after depositing the structured hard chromium layer. Thus, several layers can be deposited on the workpiece, depositing, for example, a metal layer of a conventional electrolyte on the hard chromium layer structured. Further, both layers may consist of different materials which, if a conventional metal layer is deposited on the structured hard chromium layer, enable improved anchorage of the conventional material layer.

Moreover, as the second layer, a conventional hard chromium layer or a structured hard chromium layer can be deposited, with respective inclusions which may consist of aluminum oxide, diamond and/or boron nitride of the hexagonal type. The aforementioned materials are suspended in the electrolyte used for this purpose. The inclusions lead to a further improvement in tribological properties.

Moreover, in a particularly favorable embodiment, a hard chromium layer is electrolytically deposited on a conventional hard chromium layer of uniform layer thickness. This leads to a so-called graded structured hard chromium layer in which corrosion protection is ensured by the conventional hard chromium layer having a uniform layer thickness, while the structured hard chromium layer provides an improvement of the workpiece's tribological properties.

The invention also relates to a method of producing a coating composition, wherein chromium is deposited on a workpiece, forming a structured hard chromium layer, and a composition containing epoxy resin, a solid lubricant, a hard substance, or mixtures thereof is applied on the structured hard chromium layer. The structured hard chromium layer may be a structured hard chromium layer produced according to the invention. The epoxy resin serves as a binder in order to retain the solid lubricant and/or the hard material within the recesses of the structured hard chromium layer. Particularly suitable solid lubricants are $MoS_2$, boron nitride, preferably the hexagonal type of boron nitride, or teflon, or a mixture of two or more of these substances, respectively. Examples of hard substances are microscale diamond, aluminum oxide, $Si_3N_4$, $B_4C$, SiC or a mixture of two or more of these substances.

This coating structure not only improves the general wear properties, but rather the use of $MOS_2$ additionally results in excellent emergency-running properties of the workpiece in the case of insufficient lubrication. In particular, if boron nitride is contained in the composition, this will result in excellent self-lubrication, so that the use of further lubricants can be dispensed, depending on the application. If a mixture of two or more of the aforementioned solid lubricants is used in the composition to be deposited on the structured hard chromium layer, the above-mentioned favorable tribological properties add up to each other.

An embodiment comprises a structured hard chromium layer, obtainable by any of the preceding methods.

A further embodiment comprises a coating obtainable by the preceding method for producing a coating.

Yet another embodiment comprises an electrolyte for carrying out the method of producing a structured hard chromium layer, said electrolyte comprising (a) a Cr(VI) compound in an amount corresponding to 50 to 300 g/l of chromic acid anhydride;

(b) 0.5 g/l to 10 g/l of sulfuric acid;

(c) 5 g/l to 15 g/l of aliphatic sulfonic acid comprising 1 to 6 carbon atoms;

wherein the electrolyte substantially includes none of the compounds selected from ammonium molybdate, alkali molybdate, alkaline earth molybdate, ammonium vanadate, alkali vanadate, alkaline earth vanadate, ammonium zirconate, alkali zirconate and alkaline earth zirconate.

The electrolyte, which may preferably contain the Cr(VI) compound in an amount corresponding to 50 to 150 g/l chromic acid anhydride, serves in particular to electroplate the structured hard chromium layers described in more detail above on workpieces.

EXAMPLE 1

In order to produce a conventional hard chromium layer, the following aqueous electrolyte is prepared:

| | | |
|---|---|---|
| chromic acid anhydride | $CrO_3$ | 250 g/l |
| sulfuric acid | $H_2SO_4$ | 2.5 g/l |

The workpiece to be coated is immersed in the electrolyte after conventional pre-treatment. Chromium is deposited on the product for 30 minutes at 55° C., with a current density of 40 A/dm$^2$.

The resulting product comprises a conventional, glossy and uniformly formed chromium layer, as shown in FIG. 1.

EXAMPLE 2

In order to form structured hard chromium layers, use is made of an electrolyte according to the invention which contains:

| | | |
|---|---|---|
| chromic acid anhydride | $CrO_3$ | 200 g/l |
| sulfuric acid | $H_2SO_4$ | 3 g/l |
| methane sulfonic acid | $CH_3SO_3H$ (70%) | 9 ml/l. |

Figure 2:
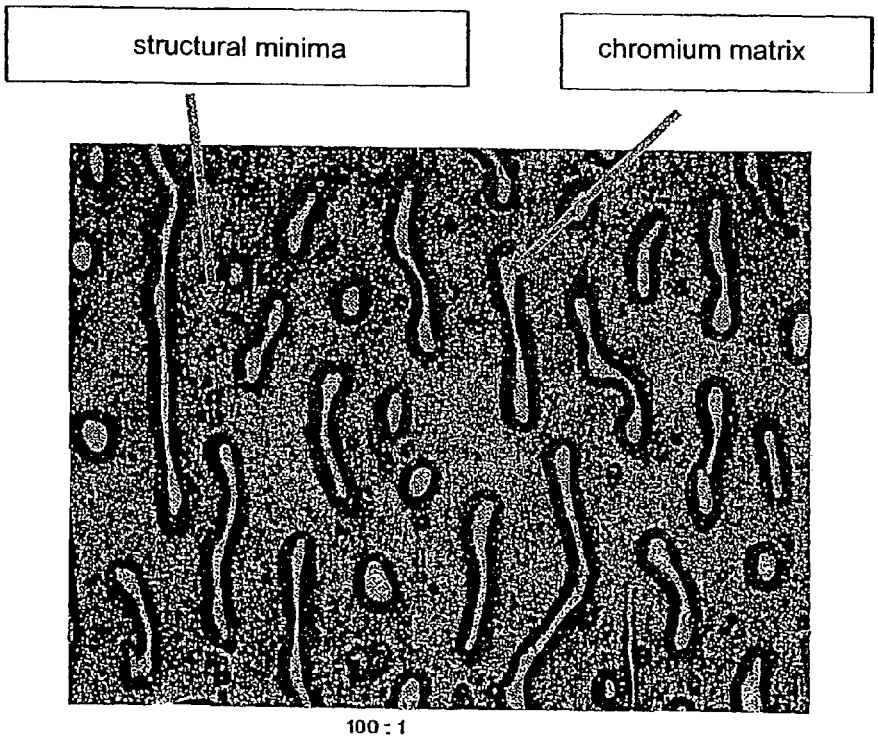
FIGS. 2-6 are photographs of a chromium layer of Example 2.
Figure 3:
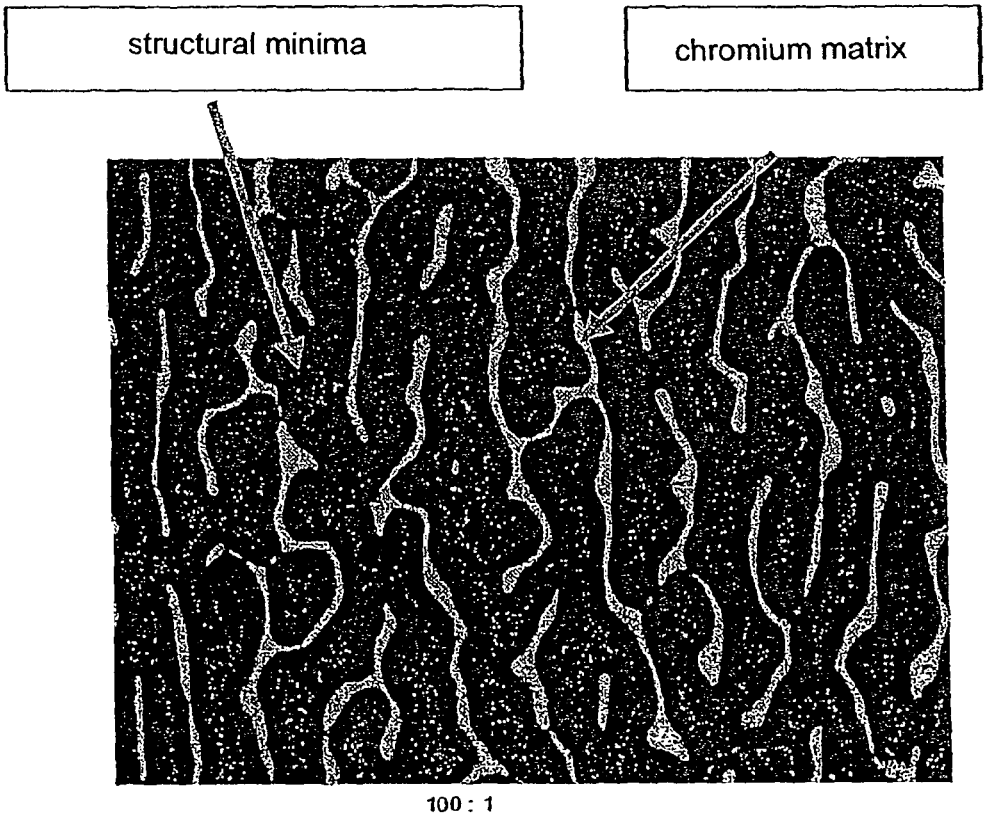
Figure 4:
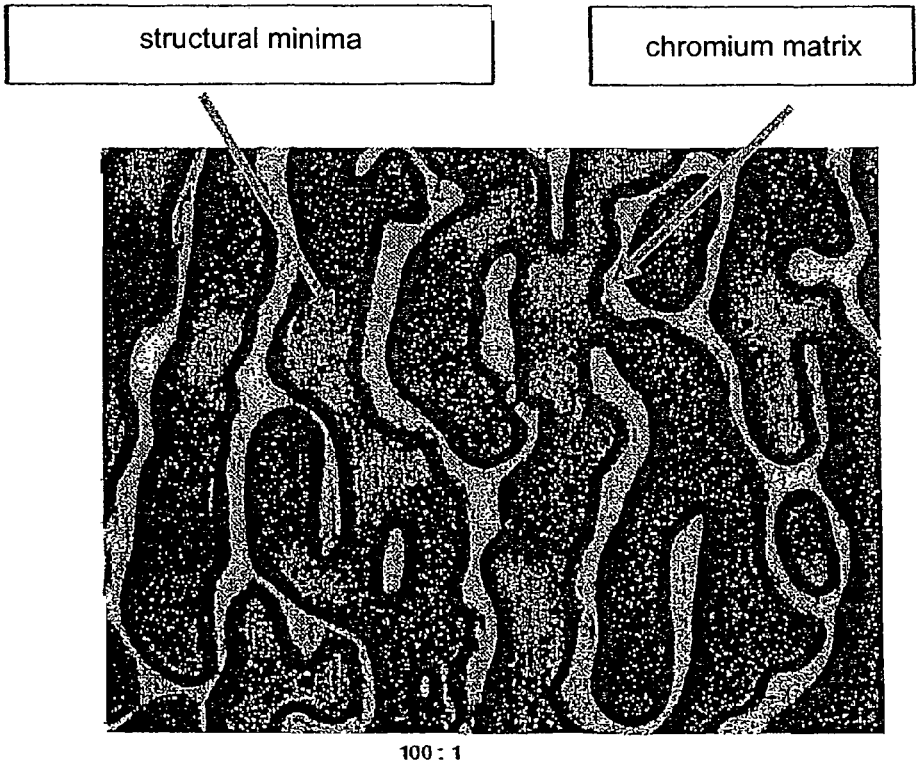
Figure 5:
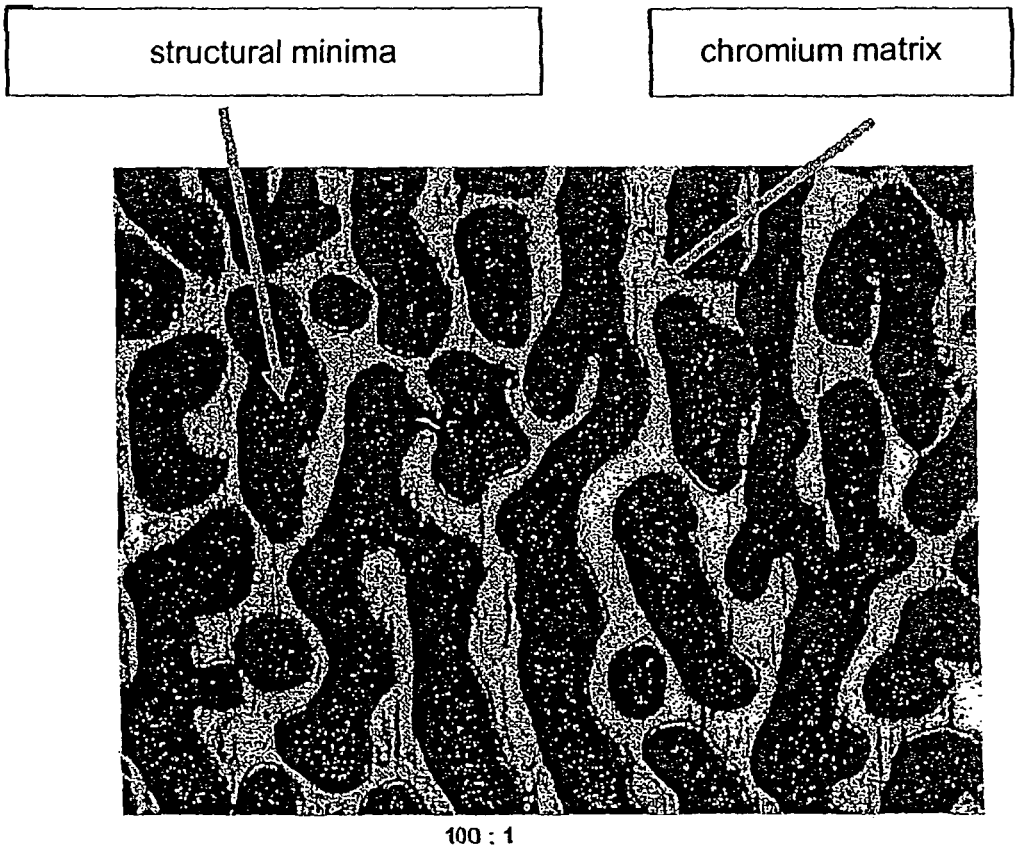
Figure 6:
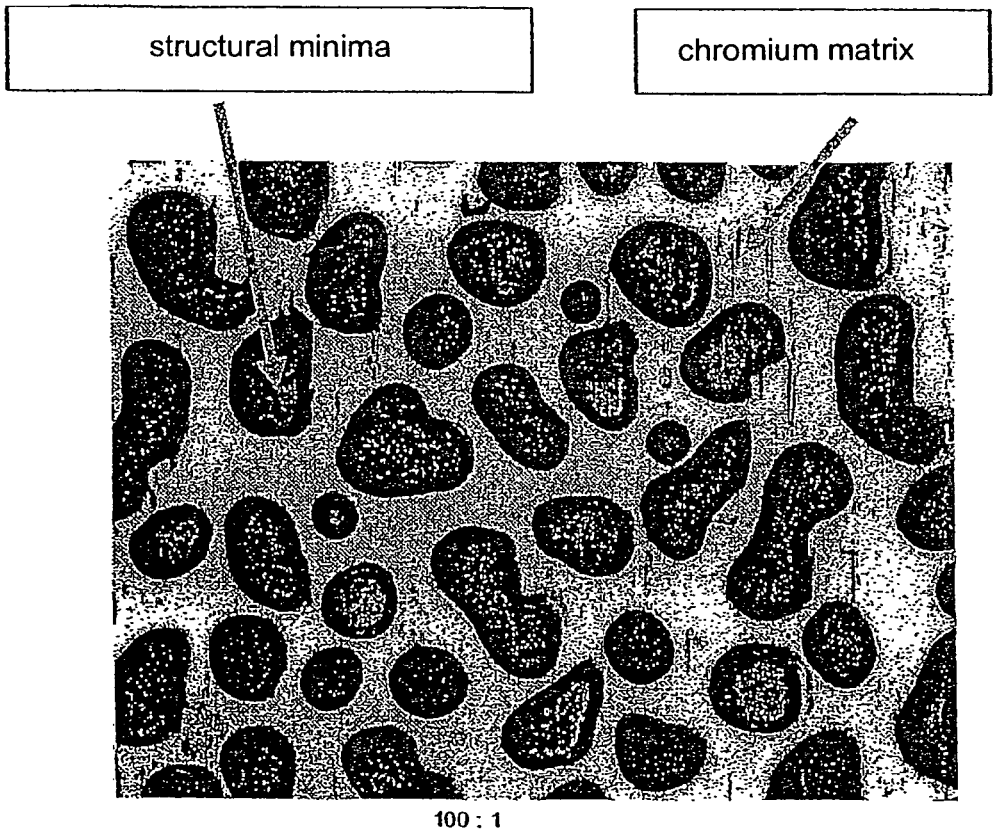

At a temperature of 70° C., a cathodic current yield of 10% and an exposure time of 30 minutes, structured hard chromium layers according to the invention are deposited on workpieces. With respect to the photographs shown in FIGS. 2 to 6, the current densities are varied as follows: FIG. 2: 30 A/dm$^2$; FIG. 3: 40 A/dm$^2$; FIG. 4: 50 A/dm$^2$; FIG. 5: 60 A/dm$^2$; FIG. 6: 70 A/dm$^2$. Typical surface structures result, with structural minima, i.e. recesses, appearing dark in the photographies.

If the current density is kept constant and the electrolyte components are modified instead, the structure formation is also influenced, however, this influence results in structures which are comparable to those of FIGS. 2 to 6.

EXAMPLE 3

Conventional hard chromium layers comprising aluminum oxide inclusions are deposited on a workpiece in a manner alternating with structured hard chromium layers. For the latter, use is made of an electrolyte containing

| | | |
|---|---|---|
| chromic acid anhydride | $CrO_3$ | 100 g/l |
| sulfuric acid | $H_2SO_4$ | 3.5 g/l |
| methane sulfonic acid | $CH_3SO_3H$ (70%) | 6 ml/l. |

Figure 7:
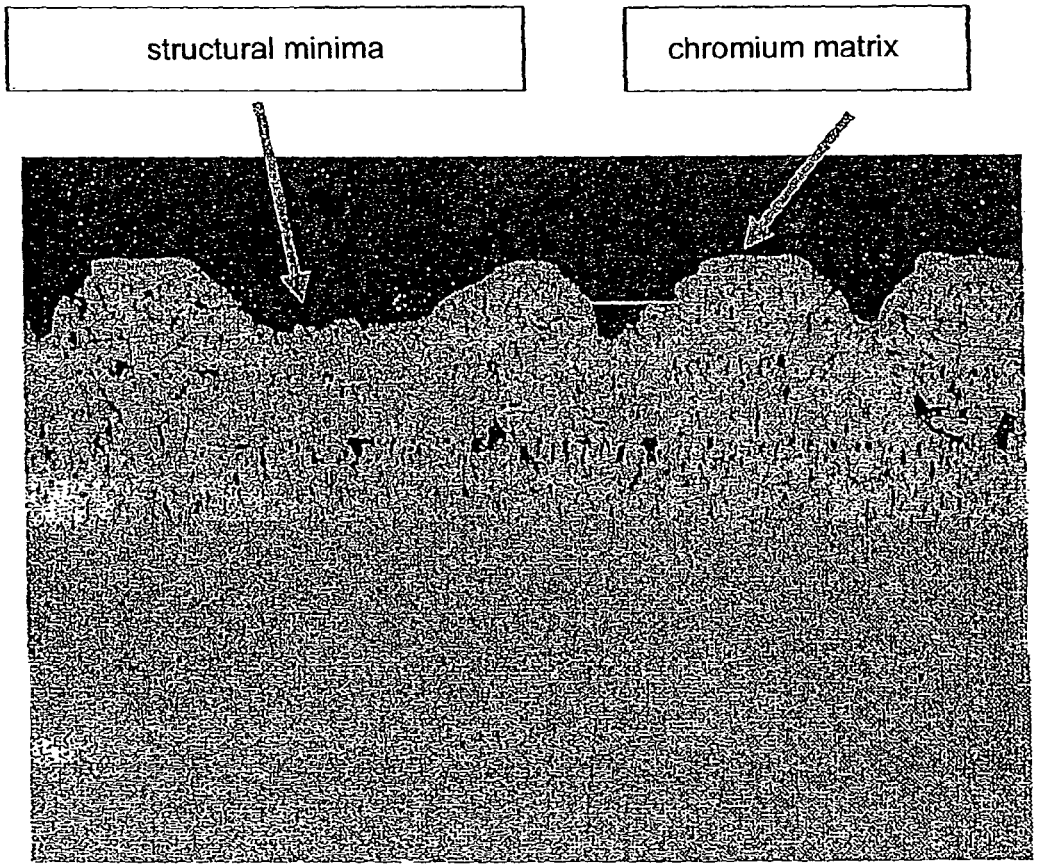
FIGS. 7-8 are photographs of a chromium layer of Example 3.
Figure 8:
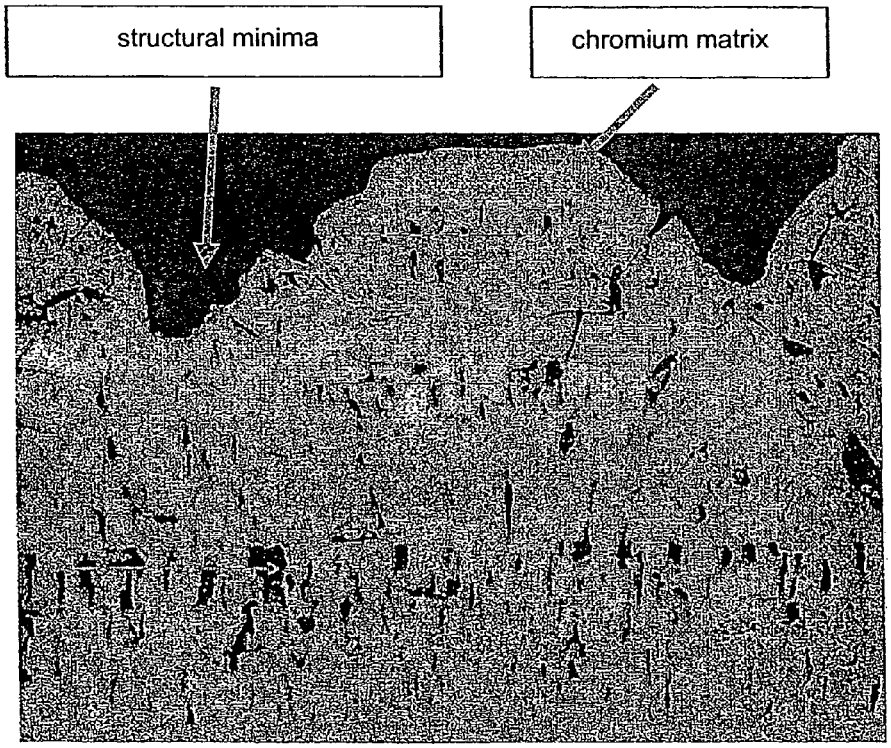

The structured hard chromium layers are deposited for 30 minutes at a temperature of 60° C., a cathodic current yield of 10% and a current density of 80 A/dm$^2$. A total of six layers are deposited with and without inclusions in an alternating fashion. FIGS. 7 and 8 show a typical cross-grain view of these graded, structured chromium layers with different magnifications. Corrosion protection is ensured by the conventional hard chromium layers, while the favorable tribological properties result from the structured hard chromium layers according to the invention. Instead of aluminum oxide, diamond or hexagonal boron nitride may also be incorporated.

The resulting graded, structured hard chromium layers can be further treated as described in Example 4 in order to support the self-lubricating properties of the surface.

EXAMPLE 4

Figure 9:
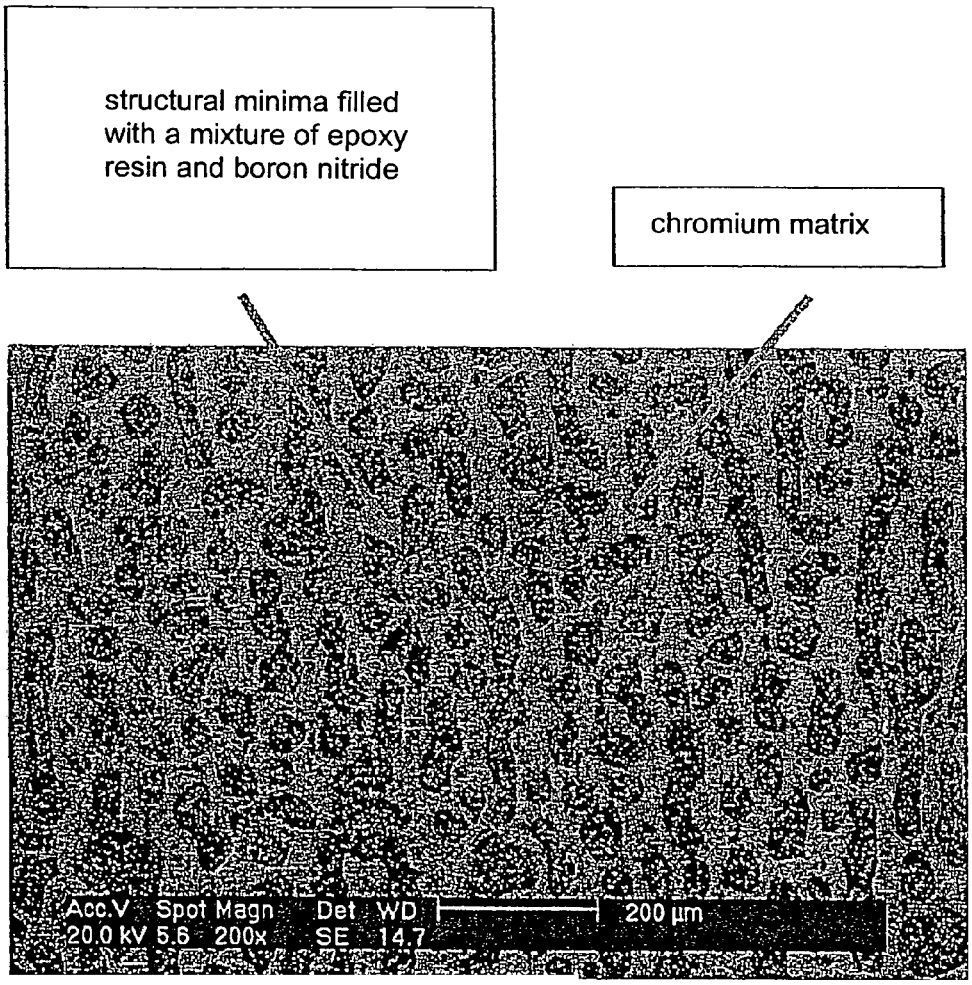
FIGS. 9-10 are photographs of chromium layers of Example 4.
Figure 10:
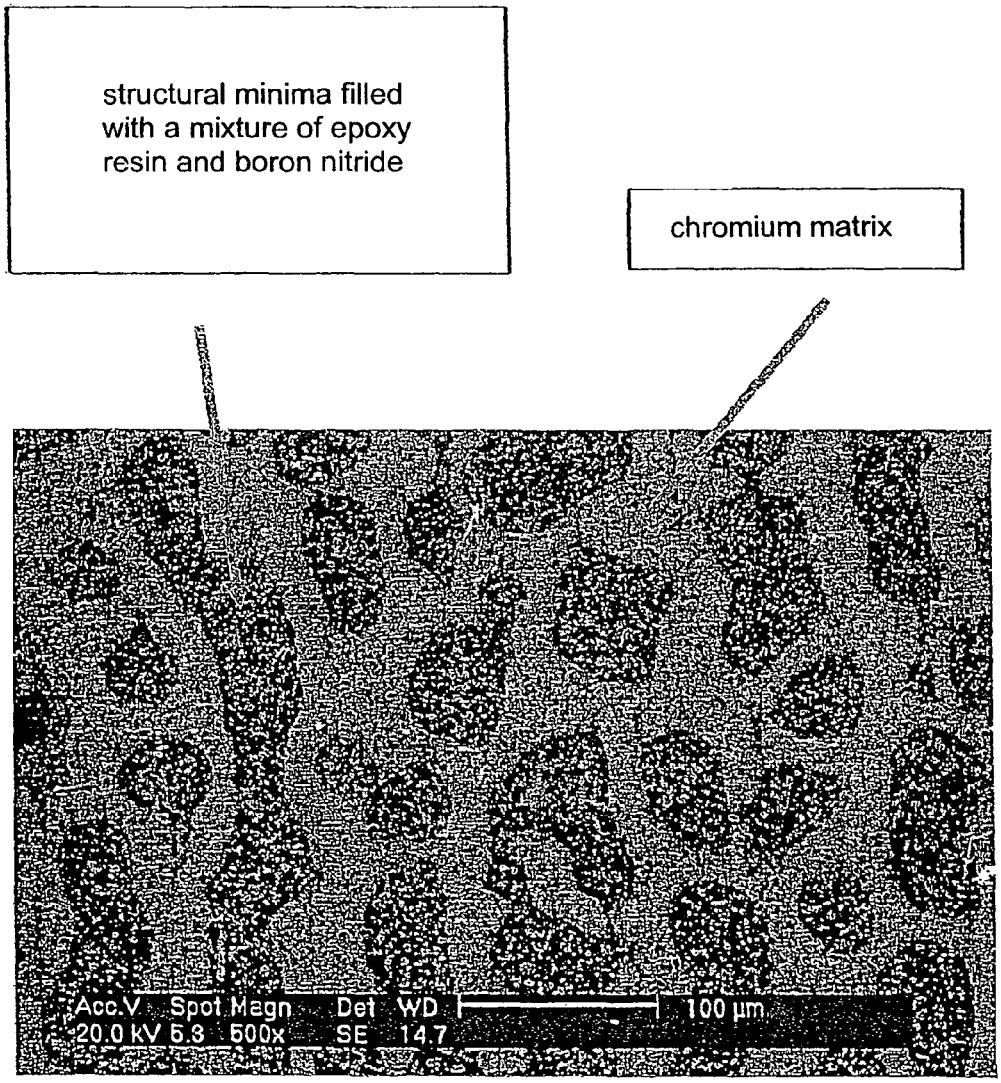

In a structured hard chromium layer, produced according to Example 2 on a workpiece, structural minima or recesses of the surface are filled with a mixture of an epoxy resin and boron nitride of the hexagonal type. The photographs of FIGS. 9 and 10 illustrate the filling of the recesses of the hard chromium layer. The coating thus formed has excellent self-lubricating properties. Moreover, depending on the application, the additional use of further lubricants is not required.

EXAMPLE 5

A workpiece, coated with a structured hard chromium layer produced according to Example 2 is treated with a mixture of an epoxy resin and $MoS_2$ such that the recesses in the chromium layer are filled with the mixture. The epoxy resin serves as a binding agent so as to fix the $MoS_2$ in the depressions and partially also at the elevations. This results in good wear properties as well as excellent emergency-running properties if insufficient lubrication of the workpiece occurs. Moreover, an improved corrosion behavior is provided as compared with the untreated structured hard chromium layer.

EXAMPLE 6

The recesses of a structured hard chromium layer produced according to Example 2 on the product are filled with a mixture of epoxy resin and microscale diamond, i.e. diamond particles having a size in the μm range. This also shows considerably improved wear properties and a substantially more favorable corrosion behavior over the unfilled structured hard chromium layer.

EXAMPLE 7

A workpiece produced according to Example 5 is additionally treated with a mixture of Example 6. The resulting coating has strongly improved tribological properties, e.g. excellent self-lubrication over Examples 5 and 6 as well as a more favorable corrosion behavior than the untreated structured hard chromium layer.

The invention claimed is:

1. A method of producing a structured hard chromium layer, the method comprising:

providing an electrolyte having a chemical composition comprising:

(a) a Cr(VI) compound in an amount corresponding to 50 to 300 g/l of chromic acid anhydride;

(b) 0.5 g/l to 10 g/l of sulfuric acid; and (c) 5 g/l to 15 g/l of aliphatic sulfonic acid comprising 1 to 6 carbon atoms;

wherein the electrolyte comprises substantially none of the compounds selected from the group consisting of ammonium molybdate, alkali molybdate, alkaline earth molybdate, ammonium vanadate, alkali vanadate, alkaline earth vanadate, ammonium zirconate, alkali zirconate and alkaline earth zirconate; and wherein the electrolyte comprises substantially no fluorides; and electrodepositing chromium from the electrolyte onto a workpiece forming a structured hard chromium layer, wherein the structured hard chromium layer is electrodeposited at a temperature between 55° C. and 90° C. and a current density between 40 A/dm$^2$ and 200 A/dm$^2$, and the chemical composition of the electrolyte, the temperature and the current density are selected such that a cathodic current yield of 12% or less is employed to form the structured hard chromium layer consisting essentially of at least one of a cup-shaped structure, a labyrinth structure, or a column-shaped structure.

2. The method of claim 1, wherein the Cr(VI) compound comprises $CrO_3$.

3. The method of claim 1, wherein the aliphatic sulfonic acid is selected from the group consisting of: methane sulfonic acid, ethane sulfonic acid, methane disulfonic acid and ethane disulfonic acid.

4. The method of claim 1, wherein the current density is between 40 A/dm$^2$ and 80 A/dm$^2$.

5. The method of claim 1, wherein a second layer is electrodeposited at least one of before or after electrodepositing the structured hard chromium layer.

6. The method of claim 5, wherein the structured hard chromium layer and the second layer are comprised of different materials.

7. The method of claim 5, wherein a hard chromium layer comprising uniform layer thickness is electrodeposited as the second layer.

8. The method of claim 1, wherein a composition comprising epoxy resin and at least one of a solid lubricant, a hard substance, or mixtures thereof is deposited on the structured hard chromium layer.

9. The method of claim 8, wherein the solid lubricant is at least one of $MoS_2$, boron nitride, teflon, or a mixture thereof.

10. The method of claim 8, wherein the hard substance is at least one of microscale diamond, aluminum oxide, $Si_3N_4$, $B_4C$, SiC, or a mixture thereof.

11. The method of claim 1, wherein the current density is between 50 A/dm$^2$ and 200 A/dm$^2$.

12. The method of claim 1, wherein the current density is between 50 A/dm$^2$ and 80 A/dm$^2$.

13. A method of producing a workpiece with a structured hard chromium layer, the method comprising:

providing a workpiece;

providing an electrolyte having a chemical composition comprising:

(a) a Cr(VI) compound in an amount corresponding to 50 to 300 g/l of chromic acid anhydride;

(b) 0.5 g/l to 10 g/l of sulfuric acid; and (c) 5 g/l to 15 g/l of aliphatic sulfonic acid comprising 1 to 6 carbon atoms;

wherein the electrolyte comprises substantially none of the compounds selected from the group consisting of ammonium molybdate, alkali molybdate, alkaline earth molybdate, ammonium vanadate, alkali vanadate, alkaline earth vanadate, ammonium zirconate, alkali zirconate and alkaline earth zirconate; and wherein the electrolyte comprises no more than about 0.1 g/l of fluorides;

electrodepositing chromium from the electrolyte onto the workpiece forming a structured hard chromium layer, wherein the structured hard chromium layer is electrodeposited at a temperature between 45° C. and 95° C. and a current density between 20 A/dm$^2$ and 200 A/dm$^2$, and the chemical composition of the electrolyte, the temperature and the current density are selected such that a cathodic current yield of 12% or less is employed to form the structured hard chromium layer consisting essentially of at least one of a cup-shaped structure, a labyrinth structure, or a column-shaped structure; and electrodepositing a conventional hard chromium layer comprising one or more hard particles selected from aluminum oxide, diamond, and boron nitride of the hexagonal type, wherein the one or more hard particles are suspended in the electrolyte.

14. The method of claim 13, wherein the Cr(VI) compound comprises $CrO_3$.

15. The method of claim 13, wherein the aliphatic sulfonic acid is selected from the group consisting of: methane sulfonic acid, ethane sulfonic acid, methane disulfonic acid and ethane disulfonic acid.

16. The method of claim 13, wherein the structured hard chromium layer is electrodeposited on the workpiece and the conventional hard chromium layer is electrodeposited on the structured hard chromium layer.

17. The method of claim 13, wherein the conventional hard chromium layer is electrodeposited on the workpiece and the structured hard chromium layer is electrodeposited on the conventional hard chromium layer.

18. The method of claim 13, wherein a composition comprising epoxy resin and at least one of a solid lubricant, a hard substance, or mixtures thereof is deposited on the structured hard chromium layer.

19. The method of claim 18, wherein the solid lubricant is at least one of $MoS_2$, boron nitride, teflon, or a mixture thereof.

20. The method of claim 18, wherein the hard substance is at least one of microscale diamond, aluminum oxide, $Si_3N_4$, $B_4C$, SiC, or a mixture thereof.

* * * * *